US006143087A

United States Patent [19]

Walter

[11] Patent Number: 6,143,087

[45] Date of Patent: Nov. 7, 2000

[54] METHODS FOR TREATING OBJECTS

[75] Inventor: Alan E. Walter, Exton, Pa.

[73] Assignee: CFMT, Inc., Wilmington, Del.

[21] Appl. No.: 09/253,629

[22] Filed: Feb. 19, 1999

Related U.S. Application Data

[63] Continuation of application No. 08/559,716, Nov. 15, 1995, abandoned, which is a continuation of application No. 08/169,725, Dec. 17, 1993, abandoned, which is a continuation of application No. 07/771,352, Oct. 4, 1991, abandoned.

[51] Int. Cl.[7] ..... B08B 3/12; B08B 5/00

[52] U.S. Cl. ..... 134/1; 134/10; 134/11; 134/30; 134/31

[58] Field of Search ..... 134/1, 10, 11, 134/21, 25.1, 25.4, 26, 30, 31, 37

[56] References Cited

U.S. PATENT DOCUMENTS

| | | |
|---|---|---|
| 61,571 | 1/1867 | Searle . |
| 539,074 | 5/1895 | Morrow . |
| 539,075 | 5/1895 | Morrow . |
| 728,148 | 5/1903 | Wever . |
| 872,494 | 12/1907 | Blackburn . |
| 1,040,463 | 10/1912 | Tokheim . |
| 1,066,993 | 7/1913 | Carey . |
| 1,313,160 | 8/1919 | Bianchini . |
| 1,318,160 | 10/1919 | Lindsay . |
| 1,845,139 | 2/1932 | Exley . |

(List continued on next page.)

FOREIGN PATENT DOCUMENTS

| | | | |
|---|---|---|---|
| 681192 | 3/1964 | Canada | 141/18 |
| 1205354 | 6/1986 | Canada | B06B 1/20 |
| 2019578 | 12/1990 | Canada | B08B 3/12 |
| 0198169 | 10/1986 | European Pat. Off. . | |
| 0 255 167 A2 | 2/1988 | European Pat. Off. | B08B 3/00 |
| 0 358 536 B1 | 9/1990 | European Pat. Off. | H01L 21/00 |
| 387886 | 9/1990 | European Pat. Off. | B08B 3/10 |
| 58-50740 | 3/1983 | Japan . | |
| 58-66334 | 4/1983 | Japan . | |
| 58-68933 | 4/1983 | Japan . | |

(List continued on next page.)

OTHER PUBLICATIONS

Marra et al., "Physical Principles of Marangoni Drying," *Langmuir,* vol. 7, No. 11, 1991, pp. 2748–2755.

Leenaars et al., "Marangoni Drying: A New Extremely Clean Drying Process," *Langmuir,* vol. 6, No. 11, 1990, pp. 1701–1703.

Koppenbrink et al., "Particle Reduction on Silicon Wafers as a Result of Isopropyl Alcohol Vapor Displacement Drying after Wet Processing," pp. 235–243 of Part III of"Particles on Surfaces 2—Detection, Adhesion, and Removal" edited by K.L. Mittal (IBM US Technical Education, Thornwood, New York) and published by Plenum Publishing Corporation of New York, New York in Jan. 1990.

Rodel Products Corp., "Wet processing system," *Microcontamination,* Feb. 1987, p. 64.

Skidmore, ed., "Cleaning Techniques for Wafer Surfaces," *Semiconductor International,* Aug. 1987, pp. 81–85 (plus cover page).

CFM Technologies Inc., "Wet Processing Systems," *Semiconductor International,* Feb. 1987, p. 123 (plus cover page and contents page).

CFM Technologies, Inc., "Full–Flow™ Semiconductor Wet Processing," 1986, pp. 1–18 (plus cover page and contents page).

(List continued on next page.)

*Primary Examiner*—Randy Gulakowski
*Assistant Examiner*—Saeed Chaudhry
*Attorney, Agent, or Firm*—Testa, Hurwitz & Thibeault, LLP

[57] ABSTRACT

An object is treated by contacting it with an organic solvent and then removing the organic solvent by directly displacing it with a fluid comprising a drying vapor (e.g., isopropyl alcohol or IPA vapor) such that substantially no liquid droplets of organic solvent or drying vapor are left on the surfaces of the object to evaporate after the direct displacement of the organic solvent with the fluid.

23 Claims, 4 Drawing Sheets

U.S. PATENT DOCUMENTS

| | | | |
|---|---|---|---|
| 1,896,004 | 1/1933 | Lewis et al. . | |
| 2,016,926 | 10/1935 | Josepowitz . | |
| 2,180,274 | 11/1939 | Bentley | 103/238 |
| 2,619,974 | 12/1952 | Daley et al. . | |
| 2,647,839 | 8/1953 | Zisman et al. . | |
| 2,706,992 | 4/1955 | Friedman et al. . | |
| 2,959,151 | 11/1960 | Ehrlich . | |
| 2,961,354 | 11/1960 | Cleveland . | |
| 2,967,120 | 1/1961 | Chaney . | |
| 3,005,417 | 10/1961 | Swaney | 103/238 |
| 3,163,149 | 12/1964 | Ivey . | |
| 3,208,157 | 9/1965 | Stark | 34/74 |
| 3,276,458 | 10/1966 | Iversen et al. . | |
| 3,285,458 | 11/1966 | Wojciechowski . | |
| 3,343,812 | 9/1967 | Moulton . | |
| 3,392,780 | 7/1968 | Brown . | |
| 3,437,543 | 4/1969 | Winings | 134/188 |
| 3,441,035 | 4/1969 | Edwards . | |
| 3,443,991 | 5/1969 | Kremm . | |
| 3,469,686 | 9/1969 | Gutsche et al. . | |
| 3,481,687 | 12/1969 | Fishman | 21/54 |
| 3,487,948 | 1/1970 | Haidegger . | |
| 3,534,862 | 10/1970 | Shambelan . | |
| 3,595,252 | 7/1971 | Conte . | |
| 3,607,549 | 9/1971 | Bielefeld et al. | 156/345 |
| 3,632,462 | 1/1972 | Barrington | 156/345 |
| 3,746,022 | 7/1973 | Fillion . | |
| 3,760,822 | 9/1973 | Evans . | |
| 3,813,311 | 5/1974 | Beck et al. | 156/17 |
| 3,826,377 | 7/1974 | Bachmann . | |
| 3,834,349 | 9/1974 | Dietze et al. . | |
| 3,870,033 | 3/1975 | Faylor et al. . | |
| 3,871,914 | 3/1975 | Goffredo et al. | 134/109 |
| 3,877,134 | 4/1975 | Shanahan . | |
| 3,881,328 | 5/1975 | Kleimola et al. . | |
| 3,923,072 | 12/1975 | Beaud . | |
| 3,923,156 | 12/1975 | Wallestad . | |
| 3,926,305 | 12/1975 | Wallestad . | |
| 3,954,644 | 5/1976 | Krezanoski . | |
| 3,957,531 | 5/1976 | Tipping et al. | 134/11 |
| 3,964,957 | 6/1976 | Walsh | 156/345 |
| 3,977,926 | 8/1976 | Johnson, Jr. et al. | 156/17 |
| 3,982,943 | 9/1976 | Feng et al. | 96/38.4 |
| 3,998,333 | 12/1976 | Kamada . | |
| 4,015,615 | 4/1977 | Weber et al. . | |
| 4,017,343 | 4/1977 | Haas | 156/642 |
| 4,029,260 | 6/1977 | Herrick . | |
| 4,039,357 | 8/1977 | Bachmann . | |
| 4,056,428 | 11/1977 | Harada et al. | 156/642 |
| 4,077,416 | 3/1978 | Johnson . | |
| 4,079,522 | 3/1978 | Ham | 34/1 |
| 4,105,468 | 8/1978 | Geshner et al. | 134/3 |
| 4,111,715 | 9/1978 | Sprengling et al. . | |
| 4,132,567 | 1/1979 | Blackwood | 134/1 |
| 4,153,164 | 5/1979 | Hofsmeister . | |
| 4,159,917 | 7/1979 | Gluck | 148/1.5 |
| 4,164,477 | 8/1979 | Whitley . | |
| 4,169,807 | 10/1979 | Zuber | 252/171 |
| 4,193,818 | 3/1980 | Young et al. | 134/1 |
| 4,197,000 | 4/1980 | Blackwood | 354/323 |
| 4,211,744 | 7/1980 | Boucher | 422/20 |
| 4,228,902 | 10/1980 | Schulte . | |
| 4,235,650 | 11/1980 | Chang . | |
| 4,246,101 | 1/1981 | Selby . | |
| 4,256,229 | 3/1981 | Lee . | |
| 4,264,374 | 4/1981 | Beyer et al. . | |
| 4,280,912 | 7/1981 | Berry . | |
| 4,282,825 | 8/1981 | Nagatomo et al. . | |
| 4,286,541 | 9/1981 | Blackwood | 118/52 |
| 4,318,749 | 3/1982 | Mayer | 134/25.4 |
| 4,321,654 | 3/1982 | Nakajo et al. . | |
| 4,323,452 | 4/1982 | Witzenburg | 210/188 |
| 4,328,081 | 5/1982 | Faxlin . | |
| 4,358,470 | 11/1982 | Rasmussen . | |
| 4,368,757 | 1/1983 | Finger . | |
| 4,382,824 | 5/1983 | Halleck | 134/1 |
| 4,383,884 | 5/1983 | Rozmus . | |
| 4,395,348 | 7/1983 | Lee . | |
| 4,408,960 | 10/1983 | Allen | 417/54 |
| 4,409,999 | 10/1983 | Pedziwiatr | 134/95 |
| 4,426,246 | 1/1984 | Kravitz et al. | 156/643 |
| 4,448,750 | 5/1984 | Fuesting | 422/20 |
| 4,477,357 | 10/1984 | Sittenfield | 210/748 |
| 4,479,849 | 10/1984 | Frantzen | 156/640 |
| 4,519,846 | 5/1985 | Aigo | 134/15 |
| 4,577,650 | 3/1986 | McConnell | 134/59 |
| 4,589,926 | 5/1986 | Holmstrand | 134/6 |
| 4,633,893 | 1/1987 | McConnell et al. | 134/95 |
| 4,640,719 | 2/1987 | Hayes et al. | 134/40 |
| 4,643,774 | 2/1987 | Kishida et al. | 134/1 |
| 4,694,527 | 9/1987 | Yoshizawa | 15/308 |
| 4,714,086 | 12/1987 | Kishida et al. | 134/95 |
| 4,722,752 | 2/1988 | Steck | 134/25.4 |
| 4,736,758 | 4/1988 | Kusuhara | 134/66 |
| 4,736,760 | 4/1988 | Coberly et al. | 134/134 |
| 4,738,272 | 4/1988 | McConnell . | |
| 4,740,249 | 4/1988 | McConnell . | |
| 4,746,397 | 5/1988 | Maeda et al. | 156/637 |
| 4,778,532 | 10/1988 | McConnell et al. | 134/10 |
| 4,795,497 | 1/1989 | McConnell et al. | 134/18 |
| 4,816,081 | 3/1989 | Mehta et al. | 134/30 |
| 4,856,544 | 8/1989 | McConnell | 134/95 |
| 4,899,767 | 2/1990 | McConnell et al. | 134/56 R |
| 4,902,350 | 2/1990 | Steck | 134/1 |
| 4,911,761 | 3/1990 | McConnell et al. | 134/11 |
| 4,917,123 | 4/1990 | McConnell et al. | 134/95 |
| 4,940,494 | 7/1990 | Petit et al. | 134/1 |
| 4,960,141 | 10/1990 | Lenck et al. | 134/61 |
| 4,967,777 | 11/1990 | Takayama et al. | 134/102 |
| 4,971,920 | 11/1990 | Miyashita et al. | 437/10 |
| 4,984,597 | 1/1991 | McConnell et al. | 134/95 |
| 5,143,103 | 9/1992 | Basso et al. | 134/98.1 |

FOREIGN PATENT DOCUMENTS

| | | | |
|---|---|---|---|
| 58-200540 | 11/1983 | Japan . | |
| 59-50530 | 3/1984 | Japan . | |
| 59-88827 | 5/1984 | Japan . | |
| 59-107519 | 6/1984 | Japan . | |
| 59-117126 | 7/1984 | Japan . | |
| 59-127838 | 7/1984 | Japan . | |
| 60-229399 | 11/1985 | Japan . | |
| 61-23324 | 1/1986 | Japan . | |
| 61-78124 | 4/1986 | Japan . | |
| 61-101032 | 5/1986 | Japan . | |
| 61-112326 | 5/1986 | Japan . | |
| 61-955360 | 5/1986 | Japan . | |
| 61-96738 | 5/1986 | Japan . | |
| 61-121336 | 6/1986 | Japan . | |
| 61-121337 | 6/1986 | Japan . | |
| 61-125136 | 6/1986 | Japan . | |
| 61-152020 | 7/1986 | Japan | H01L 21/304 |
| 61-204942 | 9/1986 | Japan . | |
| 61-228629 | 10/1986 | Japan . | |
| 61-295622 | 12/1986 | Japan . | |
| 61-295635 | 12/1986 | Japan . | |
| 62-18037 | 1/1987 | Japan . | |
| 62-45114 | 2/1987 | Japan . | |
| 62-45127 | 2/1987 | Japan . | |
| 62-115724 | 5/1987 | Japan | H01L 21/304 |
| 62-115725 | 5/1987 | Japan . | |
| 62-136824 | 6/1987 | Japan . | |
| 62-169420 | 7/1987 | Japan . | |

| | | | |
|---|---|---|---|
| 62-195128 | 8/1987 | Japan . | |
| 62-198126 | 9/1987 | Japan | H01L 21/304 |
| 62-245639 | 10/1987 | Japan | H01L 21/304 |
| 63-10528 | 1/1988 | Japan . | |
| 63-52415 | 3/1988 | Japan . | |
| 63-56921 | 3/1988 | Japan . | |
| 63-111987 | 5/1988 | Japan | B08B 3/08 |
| 947699 | 1/1964 | United Kingdom . | |

OTHER PUBLICATIONS

CFM Technologies, "Full–Flow" document, 1985, pp. 1–23 (plus cover page and contents page).

Walter et al., "Stationary In Situ Wet Chemical Processing: The Impact on Wafer Surface Phenomena," *Fine Particle Society,* Jul. 1988, pp. 1–11.

McConnell, "New Solutions for Automated Wet Processing," presented at the Fine Particle Society, 1989.

McConnell, "Investigating the Impact of Wafer History on the Removal of Particles from Silicon Surfaces," *Microcontamination,* Oct. 1990.

McConnell, "Examining the Effects of Wafer Surface Chemistry on Particle Removal Using Direct–Displacement IPA Drying," *Microcontamination,* Feb. 1991.

McConnell, "The Impact of Wafer History on the Removal of Particles from Silicon Surfaces," (date unknown, but after 1989).

McConnell, "Particle Removal from Oxide, Nitride and Bare Silicon Surfaces Using Direct–Displacement IPA Drying," presented at the Fine Particle Society, 1991.

Skidmore, "Dry Wafers Cleanly without Spinning," *Microcontamination,* contributors Walter, McConnell, and Koppenbrink, Jul. 1989.

Walter et al., "Direct Displacement Wet Processing: How it Affects Wafer Surface Phenomena," *Microcontamination,* Jan. 1990.

Walter, "Development of an Integrated Cleaning and Drying Process for Precision Parts," presented at the Microcontamination Conference, Oct. 1991.

Notice Under 35 U.S.C. § 282 by Defendant Steag Microtech, Inc. dated Oct. 15, 1997.

United States District Court for the District of Delaware, Civil Action No. 95–442–RRM, Memorandum Opinion dated Nov. 25, 1997.

United States District Court for the District of Delaware, Civil Action No. 95–442–RRM, Judgment, and Amended Order To Enter Judgment And Setting Up Schedule For Parties To Resolve Outstanding Damages Issues each dated Jul. 8, 1998; and Order For Entry Of Judgment And Granting Injunction, and Opinion each dated Jun. 18, 1998.

Principal Brief for Appellant Steag Microtech, Inc. to the United States Court of Appeals for the Federal Circuit (which appeals from the United States District Court for the District of Delaware, Civil Action No. 95–442–RRM, Judge Roderick R. McKelvie) dated Sep. 3, 1998.

CFM Technologies, Inc., "Ultra–Flow™ Precision Cleaning," product brochure, May 1, 1991.

Bioact®* Cleaners, "Safe, High Performance, Long–Term Replacement Systems," Apr., 1991.

Meissner et al., "Surface Tensions of Pure Liquids and Liquid Mixtures," Massachusetts Institute of Technology, Cambridge 39, Mass., vol. 41, No. 12, pp. 2782–2787 (1949).

Sternling et al., "Interfacial Turbulence: Hydrodynamic Instability and the Marangoni Effect," *A.I.Ch.E. Journal,* v. 5, n. 4, pp. 514–523 (1959).

Scriven et al., "The Marangoni Effects, Chemical Engineering Department," *Nature,* v. 187, n. 4733, pp. 186–188 (1960).

Furnridge, "Studies At Phase Interfaces I. The Sliding Drops on Solid Surfaces And Theory For Spray Retention," *J. Colloid Science* 17, pp. 309–324 (1962).

Bernett et al., "Surface Chemical Displaement of Organic Liquids From Solid Surfaces," *J. Phys. Chem.,* v. 70, n. 4, pp. 1064–1075 (1966).

Hansen et al., "Dynamic Contact and Its Relationship to Forces of Hydrodynamic Origin," *J. Colloid & Interface Science,* v. 37, n. 1, pp. 196–207 (1971).

Meeks et al., "Silicon Surface Contamination: Polishing and Cleaning," *J. Electrochem. Soc.,* v. 120, n. 9, pp. 1241–1246 (1973).

Dussan et al., "On the Motion of a Fluid–Fluid Interface Along a Solid Surface," *J. Fluid Mech.,* v. 65, pt. 1, pp. 71–95 (1974).

Tolliver, "LSI Wafer Cleaning Techniques," *Solid State Technology,* pp. 33–36 (1975).

Dussan, "On The Spreading Of Liquids On Solid Surfaces: Static And Dynamic Contact Lines," *Ann. Rev. Fluid Mech.* 1979, v. 11, pp. 371–400 (1979).

Peters et al., "Removal Of Photoresist Film Residues Wafer Surfaces," *J. Electrochem. Soc.,* v. 126, n. 5, pp. 883–886 (1979).

Blake et al., "A Maximum Speed Of Wetting," *Nature,* v. 282, pp. 489–491 (1979).

Ngan et al., "On The Nature Of The Dynamic Contact Angle: An Experimental Study," *J. Fluid Mech.,* v. 118, pp. 27–40 (1982).

Ito et al., "Properties Of Passivation Film On Silicon Due to HF–NO2, Mixed Gas Reaction," *Japanese J. of Applied Physics,* v. 22, n. 4, pp. 603–610 (1983).

Duffalo et al., "Particulate Contamination and Device Performance," *Solid State Technology,* pp. 109–114 (1984).

Hoenig et al., "Improved Contamination Control in Semiconductor Manufacturing Facilities," *Solid State Technology,* pp. 119–123 (1984).

Tolliver, "Contamination Control: New Dimensions in VLSI Manufacturing," *Solid State Technology,* pp. 129–137 (1984).

Kern, "Purifying SI and SiO2 Surfaces with Hydrogen Peroxide," *Semiconductor International,* pp. 94–99 (1984).

Weiss, "Wafer Cleaning Update," *Semiconductor International,* pp. 82–85 (1984).

Kugimiya et al., "Self Cleaning of the Si Surface In Molecular Beam Epitaxy," *Electrochemical Soc. Extended Abstracts,* v. 85–1, pp. 164–165 (1985).

Kugimiya et al., "Self Cleaning of the Si Surface In Molecular Beam Epitaxy," *Electrochemical Soc.,* v. 85–7, pp. 35–44 (1985).

Wolf et al., "Wet Processing: Cleaning, Etching and Liftoff," *Silicon Processing for the VLSI Era,* v. 1, pp. 514–517 (1986).

Iscoff, "The Challenge For Ultrapure Water," *Semiconductor International,* pp. 74–82 (1986).

Balasz, "A Summary Of New Methods For Measuring Contaminants In Ultrapure Water," *Microcontamination,* pp. 35–62 (1987).

Davison et al., "Ultrapure Piranha Solution for ULSI Applications," *Electrochemical Society Extended Abstracts,* v. 87–1, pp. 310–311 (1987).

McConnell, "New Solutions For Automated Wet Processing," *Electrochemical Society Extended Abstracts,* v. 87–2, pp. 902–903 (1987).

Schmidt et al., "The Effect Of Chemical Filtration In A Centrifugal Spray System On Wafer Surface Particle Counts," *Electrochemical Society Extended Abstracts,* v. 87–2, pp. 902–903 (1987).

Shenai et al., "Contact Resistance of A1 + 1% Si and Mo/LPCVD W Metallizations to n– and p+ Doped Silicon for Power Devices," *Electrochemical Society Extended Abstracts,* v. 87–2, pp. 1005–1006 (1987).

Osburn et al., "The Effects of Contamination on Semiconductor Manufacturing Yield," *J. Env. Sci.,* pp. 45–53 (1988).

Leenaars, "A New Approach to the Removal of Sub–Micron particles from Solid (Silicon) Substrates," *Symposium on Particles on Surfaces: Detection, Adhesion and Removal,* pp. 361–372 (1986).

Baker et al., "Water–Displacing Fluids And Their Applications To Reconditioning And Protecting Equipment," NRL Report C–3364 (1948).

Baker et al., "Cleaning By Surface Displacement of Water And Oils," *Industrial and Engineering Chemistry,* v. 59, n. 6, pp. 29–40 (1967).

Bolster, "Removal of Fluid Contaminants by Surface Chemical Displacement," *Surface Contamination Genesis, Detection and Control,* v. 1, pp. 359–368 (1978).

Mishima et al., "High Purity Isopropanol and its Application to Particle–Free Wafer Drying," 9th ICCS Proceedings 1988, pp. 446–456 (1988).

Ohmi et al., "Wafer Cleaning and Drying Technology," Ultraclean Technology Symposium, pp. 399–419 (1985).

METHODS FOR TREATING OBJECTS

This is a continuation of application Ser. No. 08/559,716, filed Nov. 15, 1995 now abandoned, which is a continuation of Ser. No. 08/169,725, filed Dec. 17, 1993, now abandoned, which is a continuation of Ser. No. 07/771,352, filed Oct. 4, 1991, now abandoned.

BACKGROUND OF THE INVENTION

There are numerous applications for the cleaning of sensitive components, such as spacecraft components, bearings, and electronic equipment. Electronic or electrical components can become contaminated through usage, e.g., by smoke, dust, and other airborne contaminants, or by oils or lubricants. Oils are more difficult to displace than many other contaminants due to their lower surface tensions and higher viscosities, which make them difficult to remove with many solvents and/or detergents.

A number of alcohols, fluorinated alcohols and other halogenated compounds have been found to be effective as displacing agents for contaminants, particularly oily contaminants. For example, chlorinated hydrocarbons and chlorofluorocarbons (CFCs), such as Freons™, are commonly used. Concentrated corrosive acids or bases have also been used as cleaning agents. These reagents are often costly, hazardous to handle and present environmental and disposal problems.

Sonic cleaning has been used for decontaminating and/or disinfecting instruments used in medical, dental, surgical or food processing, for example. This method generally involves placing the instruments in an aqueous bath and treating them with ultrasonic energy. Treatment with ultrasonic energy has long been recognized to be lethal to microorganisms suspended in a liquid, as described, for example, by Boucher in U.S. Pat. No. 4,211,744 (1980). Ultrasonic energy has also been used for cleaning and sterilizing contact lenses (U.S. Pat. No. 4,382,824 Halleck (1983)), surgical instruments (U.S. Pat. No. 4,193,818, Young et al. (1980) and U.S. Pat. No. 4,448,750 (1984)) and even body parts, such as a doctor's hands (U.S. Pat. No. 3,481,687, Fishman (1969)).

After fluid processing, the components normally need to be dried. Evaporation of rinsing liquids is not desirable since it often leads to spotting or streaking. Even the evaporation of ultra high purity water can lead to problems when drying on the surfaces of some components. For example, such water can dissolve traces of silicon and silicon dioxide on semiconductor surfaces, and subsequent evaporation will leave residues of the solute material on the wafer surface.

A device known as a spin-rinser-drier is useful for drying objects without water evaporation. These devices utilize centrifugal force to "throw" the water off the surfaces of the object. This can cause breakage because of the mechanical stress placed on the object, particularly with larger or fragile objects. In addition, contamination control is problematic due to the mechanical complexity of the spin-rinser-drier. Since the objects conventionally travel through dry nitrogen at a high velocity, static electric charges can develop on the surface of the object. Oppositely charged airborne particles are then quickly drawn to the object's surface when the drier is opened, resulting in particulate contamination. Finally, it is difficult to avoid evaporation of water from the surface of the object during the spin cycle with the attendant disadvantages discussed above.

More recently, methods and devices have been developed for steam or chemical drying of sensitive objects. Chemical drying generally comprises two steps. First, the rinsing fluid is driven off and replaced by a non-aqueous drying fluid. Second, the non-aqueous drying fluid is evaporated using a pre-dried gas, such as nitrogen. A method for chemically drying semiconductor wafers using isopropanol is described in U.S. Pat. No. 4,778,532, and in U.S. Pat. No. 4,911,761.

It is an object of the present invention to provide a process and apparatus which can be used for degreasing, cleaning and drying of sensitive components, particularly components having complex configurations.

SUMMARY OF THE INVENTION

The present invention relates to methods and apparatus for cleaning the surface of an object by placing the object in an enclosed vessel and sequentially passing cleaning and/or rinsing fluids through the vessel, then drying the object under conditions which do not permit the deposition of residues on the surface of the object. The cleaning and rinsing fluids are selected based on the type of contamination to be removed and can include aqueous and non-aqueous fluids. In a preferred embodiment, sonic energy is applied to at least one of the fluids in the vessel.

The process is particularly useful for cleaning sensitive electronic components, such as complex parts, e.g., reading heads used in computer systems for reading and/or recording information on disks. The process is useful for cleaning hard disks, aerospace parts (e.g., gyroscopes, ball bearings), medical devices and other precision parts. The process can be used to deflux printed circuit boards, and for degreasing microparts, in particular, as a replacement-for traditional Freon™ processing. Components having numerous interfaces and facets, that is, which are involuted, can be thoroughly cleaned and dried using the present method. The present protocols can be used on metallic, ceramic or plastic surfaces.

The apparatus comprises an enclosure for enclosing the object to be cleaned, and means for passing a flow of liquid though the enclosure and around the object disposed therein. Cleaning and rinsing liquids are preferably introduced into the vessel through a port located in the bottom of the vessel. The apparatus may include a means for agitating the liquid to permit thorough cleaning or rinsing of all surfaces. Preferably a means for generating sonic waves, which can be ultrasonic or megasonic energy, is used for this purpose. The apparatus optionally can contain spray heads for pre-cleaning the object by spraying it with a liquid to remove gross contaminants. The apparatus contains a means for removing the liquid from the enclosure which can be a second port located at the top of the vessel, and means for drying the object by filling the vessel with an organic drying solvent or vapor.

In a preferred embodiment of the invention, means for introducing inert gas or air and means for circulating the washing or rinsing liquids through the vessel are included in the apparatus. The vessel preferably comprises a port at its top so that a fluid in the vessel can be vented out the top port while a second fluid is introduced into the vessel through the bottom port. Vapor or gas is introduced through an inlet at the top to displace a fluid downwardly through the bottom. This allows one fluid to be directly replaced with another fluid without exposing the objects to air. The two ports may be connected via a line, thereby permitting a fluid to be circulated through the vessel. The apparatus preferably includes means for supplying the vessel with a washing or rinsing liquid without exposing the fluid to the air. In one embodiment, a storage tank containing the liquid is connected to the vessel via a line. The storage tank may be supplied with a means for pressurizing the tank, for example, with an inert gas. The washing or rinsing liquid is then returned to the tank after use. In another embodiment, the apparatus contains means for filtering, distilling or otherwise recycling the liquids for reuse in the present system.

The method of the invention generally involves the following steps: placing the object to be cleaned in the vessel and sealing the vessel; filling the vessel with a washing fluid to immerse the object and contact all of the surfaces of the object with the fluid; preferably, agitating the liquid using sonic energy or other agitating means; filling the vessel with a rinsing fluid to displace the washing fluid and to immerse the object; and removing rinsing fluid from the surfaces of the object using an organic drying solvent under conditions such that substantially no rinsing fluid droplets, cleaning agents or contaminants are left on the surfaces of the object after removal of the rinsing fluid. The vessel can be purged with an inert gas, such as nitrogen, and/or with air, prior to removing the object from the vessel.

In one embodiment of the method, the object of interest is cleaned using an aqueous or semi-aqueous protocol. In this embodiment, the object is immobilized in the enclosure and, optionally, prerinsed by spraying the object with water. The enclosure is then filled with rinse water to remove mechanically displaced surface contaminants or gross particulates. In the aqueous protocol, the object is then immersed in a cleaning solution comprising a water/surfactant mixture. In the semi-aqueous protocol, the cleaning liquid is preferably a hydrocarbon solvent/surfactant mixture. Ultrasonic or megasonic energy can be applied through the liquid medium if desired or needed. The resulting agitation allows even involuted or hard-to-reach surfaces of the component to be thoroughly cleaned. The parts remain stationary while the cleaning and rinsing fluids move around them. The component is rinsed again with water to remove the surfactant. In a preferred embodiment, the final rinse is followed by a drying step in which a water-miscible organic vapor, e.g., alcohol or acetone vapor, is injected into the vessel. The organic vapor drives the water from all surfaces of the component. The vessel containing the alcohol-dried component can then, optionally, be purged with nitrogen and/or air prior to removing it from the vessel. This ensures that all surfaces of the object are thoroughly dried and residue-free.

In another embodiment of the method, the object of interest is cleaned using a non-aqueous protocol. The object is immobilized in the enclosure and, optionally, prerinsed with water or an organic solvent to remove gross particulates. The object is then immersed in an organic cleaning solvent, preferably a terpene or mixture of terpenes. The terpene solvent optionally can contain a surfactant. Ultrasonic or megasonic energy is applied if necessary or desirable. The cleaning solvent is then drained from the vessel, and the vessel is filled with a rinsing solvent which solubilizes residual cleaning solvent and removes it from the surfaces of the object. This rinsing step can be followed by drying with hot organic vapor. The vessel is then purged with an inert gas which thoroughly dries the object before it is exposed to air.

The method and apparatus are particularly useful for ultracleaning of objects which must be as free as possible of contamination. The combination of precise control of solvent, washing and rinsing reagents, hydraulically full flow, ultrasonic or megasonic energization and removal of rinse droplets and/or contaminants with a drying solvent or vapor permits extraordinarily thorough cleaning and rinsing to produce essentially contaminant-free surfaces. The results achieved through use of the apparatus and process of the invention is referred to hereafter as "ultracleaning".

The present apparatus and method incorporates many desirable features for cleaning sensitive electronic components, ball bearings, printed circuit boards, medical devices, hard disks for computers and precision parts. The apparatus and method can be used to thoroughly clean and/or decontaminate the surfaces of objects containing many small parts, involuted surfaces or having a highly complex configuration. The reaction vessel is a totally enclosed environment, therefore contact of a human operator with aggressive cleaning solvents or solvents having a strong odor, such as terpenes, is eliminated. The use of terpenes is particularly advantageous in that terpenes are naturally occurring, biodegradable, and are excellent solvents for most contaminants. Terpenes can be used for cleaning objects which traditionally required the use of Freons, which are costly and environmentally harmful. The odor associated with most terpenes is not problematic because the system is completely enclosed.

The objects to be treated are immobilized in the vessel, so fragile or sensitive parts can be cleaned with no product movement. Non-aqueous solvents can be recycled for repeated reuse. The apparatus and method provides a combined cleaning and drying tool, thereby reducing equipment cost, minimizing product movement and exposure to chemicals. The method eliminates harmful gas-liquid interfaces, which can result in flash corrosion and/or staining, and protects the cleaned product from sources of external contamination. The method can be adapted for automated chemical handling and comprehensive computer integration of the process.

BRIEF DESCRIPTION OF THE DRAWINGS

The foregoing summary and objects of the invention, and the various features thereof, as well as the invention itself, may be more fully understood from the following description, when read together with the accompanying drawings.

DETAILED DESCRIPTION OF THE INVENTION

The present invention is directed to the ultracleaning of objects, particularly objects having complex configurations. The present apparatus and methods will be described herein with particular reference to the ultracleaning of involuted microparts, however, the general principles apply to the cleaning of other objects.

Figure 1:
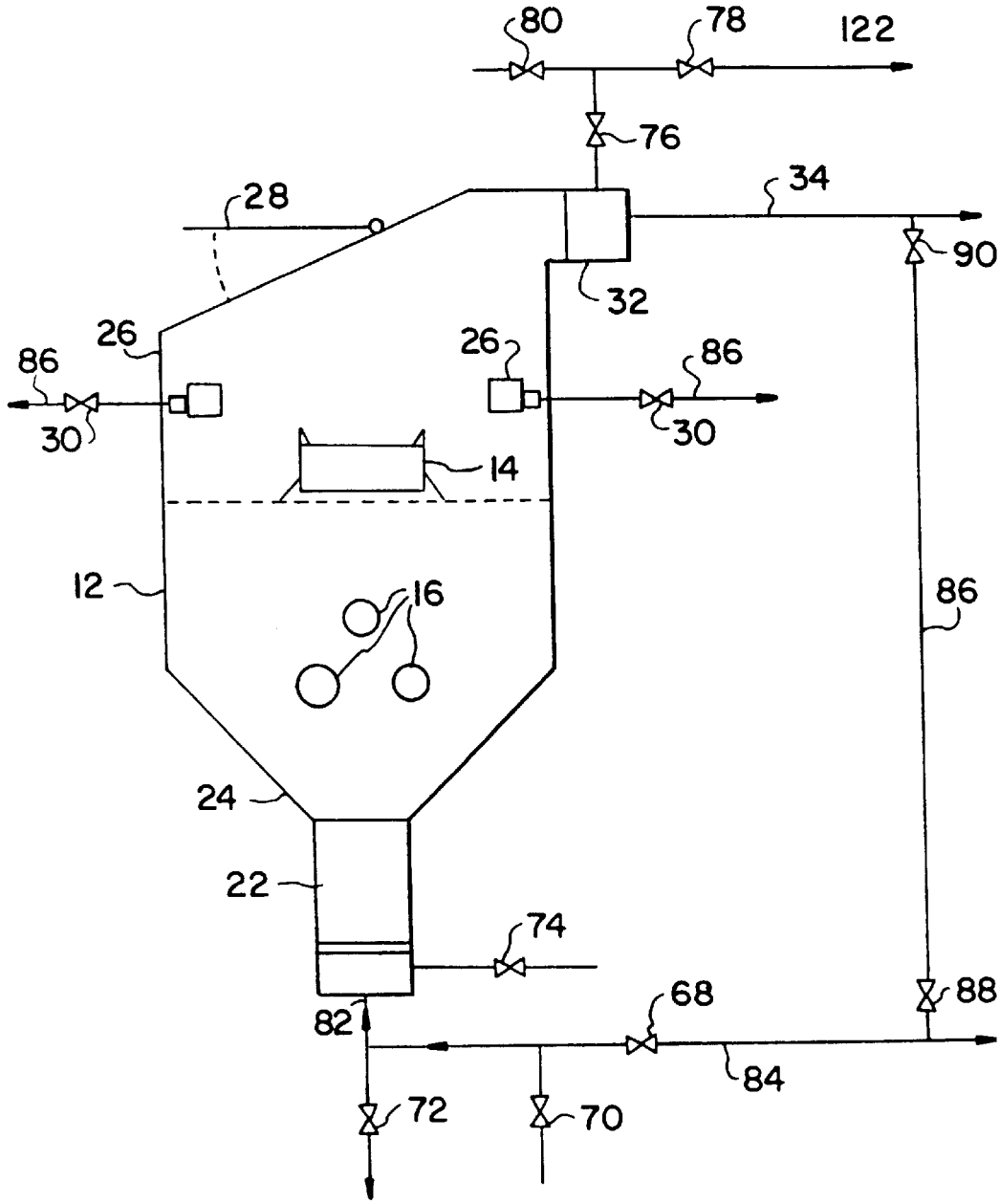
FIG. 1 is a schematic cross-sectional diagram illustrating an embodiment of the apparatus of the present invention for aqueous processing.

Referring to the drawings, an apparatus suitable for carrying out the present ultracleaning method using an aqueous protocol is shown schematically in FIG. 1. A vessel 12 holdings the object(s) for treatment with aqueous washing and rinsing fluids, and water-miscible organic gases and drying vapors. Vessel 12 contains disposed within its chamber means 14 for supporting or otherwise holding the objects to be cleaned which can be, for example, a basket, rack, tray or other device. The configuration of holding means 14 will depend in part upon the size, type and configuration of the object(s) to be cleaned. Sealable hatch door 28 allows access to the interior of vessel 12. Vessel 12 has a tapered bottom comprising sloping walls to facilitate draining of cleaning and rinsing fluids from the vessel. Vessel 12 is provided with valves 70 and 72 for the control of water for rinsing and/or cleaning, which may enter and exit vessel 12 for treatment of the objects.

Water is introduced via valve 70 through lines 84, 82 and inlet 22 which allows vessel 12 to be filled with the treatment fluid. The fluid flows upwardly through vessel 12. An inlet 74 for adding surfactant to the water is also provided. After filling of vessel 12, valve 70 for controlling the water supply is closed. In a preferred embodiment, vessel 12 has at least one sonic transducer 16 mounted in the sides of vessel 12 for inducing ultrasonic or megasonic cavitation in a treatment fluid.

Vessel 12 optionally contains spray heads 26 mounted in the sides of the vessel. The spray heads spray water or other fluid onto the objects in the vessel to prerinse the objects in order to remove gross dirt and contaminants. The prerinsing fluid is conducted to spray heads 26 through conduit 86 by opening valve 30.

Cleaning and rinsing fluids which are used in the process can be removed from the vessel by draining through port 24 and inlet 22. Valve 72 is opened to permit the used liquid to be removed for disposal through line 82. Alternatively, a first fluid in vessel 12 can be displaced by injecting a second fluid through inlet 22 and port 24 and opening port 32, thereby forcing the first fluid to the top of the vessel through port 32 and line 24. This method allows direct displacement of one fluid by another without exposing the objects inside the vessel to air. Line 34 can lead to a drain, or a holding tank for the fluid.

In another embodiment of the process, fluid can be circulated through a loop created by connecting line 84 with line 34. In this aspect, shown in FIG. 1, lines 34, 84 are connected by line 86. Valves 88 and 90 are opened to form a complete loop including vessel 12 and lines 34, 86, 84 and 82. This embodiment achieves purity of the treatment fluid by providing a closed fluid loop in which the treatment fluid can be circulated to provide fluids at controlled flow and temperature conditions, while permitting efficient and complete changing of the fluids in the loop. A plurality of different fluids can be mixed and delivered to the loop without contaminating or being contaminated by any mechanical parts other than the necessary valves and conduits, while efficiently conserving the fluids.

Figure 2:
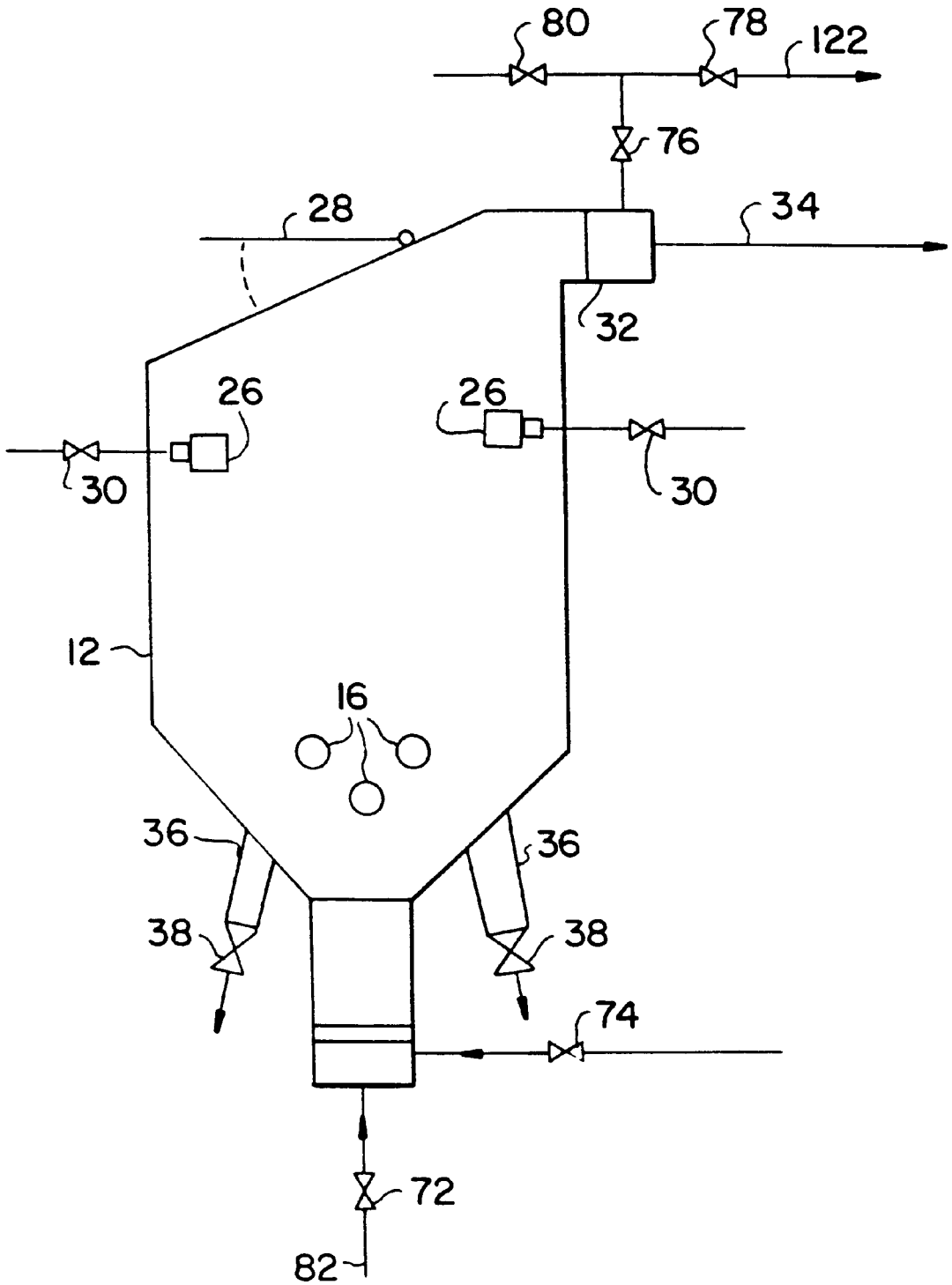
FIG. 2 is a schematic cross-sectional diagram illustrating an embodiment of the apparatus of the present invention for aqueous processing, including drain valves for removing fluids from the vessel.

Another embodiment of the present apparatus is shown in FIG. 2. In this embodiment, vessel 12 is provided with one or more drains 36 for removing cleaning and rinsing fluids from the vessel. In this aspect, the objects to be cleaned are placed in vessel 12 as described above. The vessel is filled with aqueous cleaning or rinsing fluid through line 82 and valve 70. The fluids are drained out through drains 36 by opening valves 38.

Figure 3:
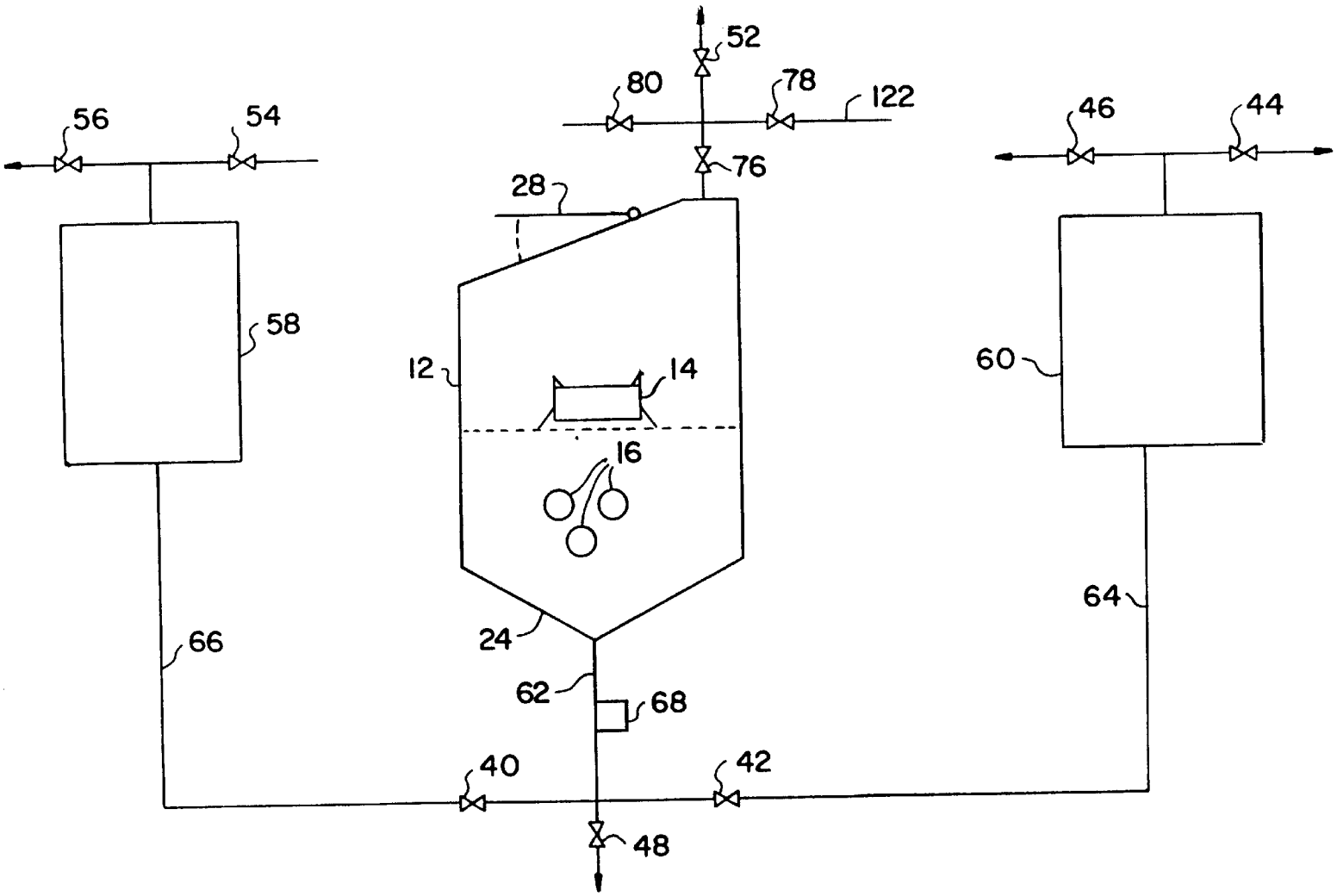
FIG. 3 is a schematic diagram illustrating an embodiment of the apparatus of the present invention for non-aqueous processing, including chemical storage tanks and conduits, valves, and associated equipment for reuse of valuable solvents.

A vessel which is appropriate for use with organic solvents is shown in FIG. 3. As shown in FIG. 3, one or more storage tanks 58, 60 for storing the cleaning, rinsing or drying solvents are connected to vessel 12 via lines 66 and 64. Each storage tank is preferably equipped with a nitrogen supply 44, 54 and exhaust 46, 56. In operation, nitrogen is admitted to tank 58 or 60 to pressurize the contents, and valve 40 or 42 is opened, causing the solvent in the tank to flow into vessel 12 through inlet 62. Once the cleaning or rinsing cycle is complete, the solvent is drained back through line 62 and returned to the tank for reuse or recycling. The apparatus can contain a gauge 68 which indicates the level of solvent in the vessel.

The apparatus contains a means for drying the objects using a drying solvent, which can be in liquid or vapor form. In a preferred embodiment, the drying solvent is a hot organic vapor. For this purpose, each apparatus shown in FIGS. 1, 2 and 3,includes an inlet for introducing hot organic drying vapor into vessel 12. As shown in FIGS. 1, 2 and 3, the organic drying vapor is introduced into vessel 12 through valves 78 and 76. The organic vapor is supplied to the vessel from a device which vaporizes the organic solvent. An apparatus and process for utilizing drying vapor is described in U.S. Pat. No. 4,911,761, which is incorporated herein by reference. A suitable device 120 for use in the present system is shown in FIG. 4.

Figure 4:
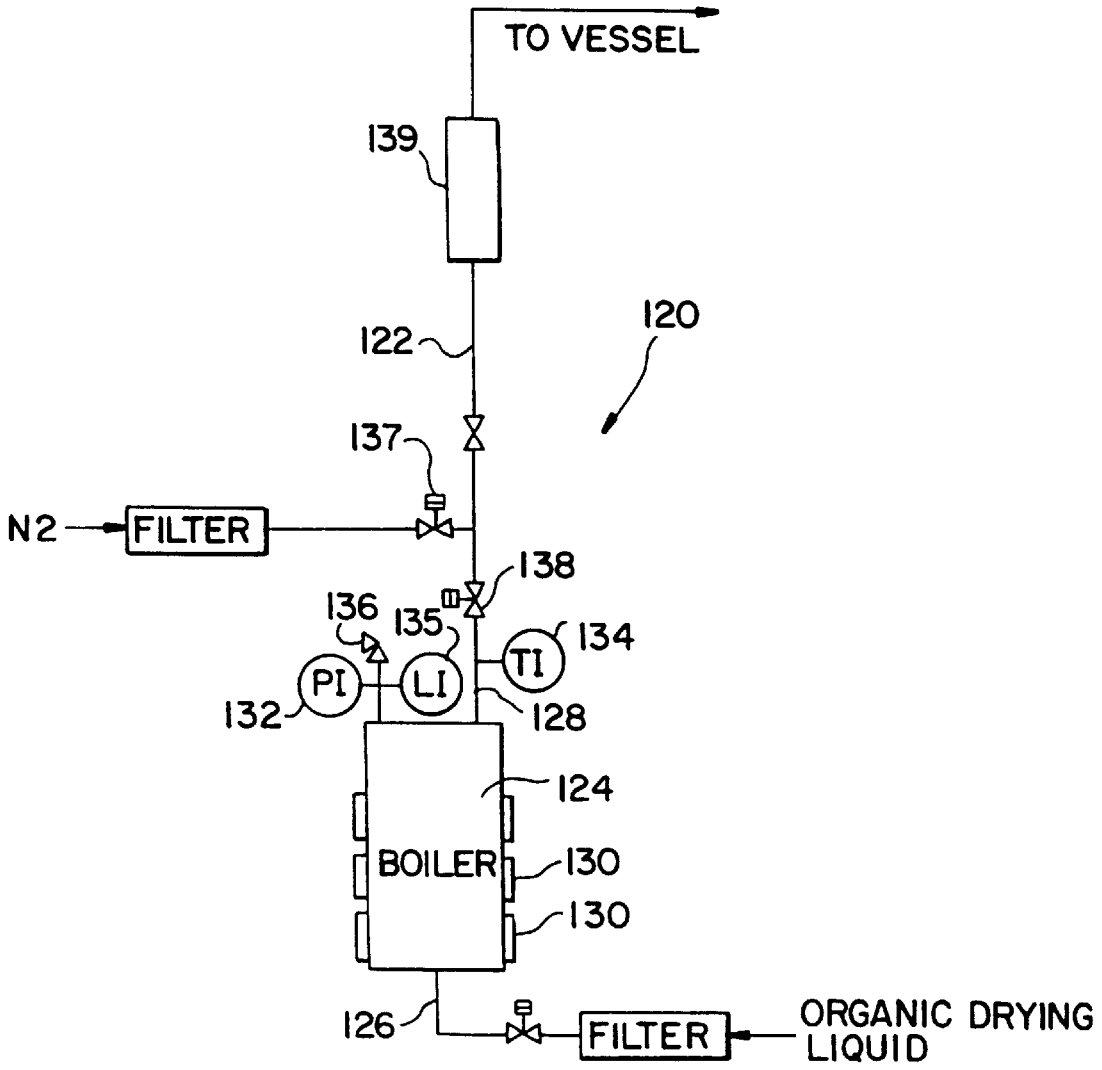
FIG. 4 is a schematic diagram illustrating an apparatus for providing organic drying vapor to the vessel.

As shown in FIG. 4, device 120 contains a boiler 24 for producing the organic drying vapor. Boiler 124 contains an inlet 126 and an outlet 128, and is provided with heating bands 130 or other suitable heat transfer device to quickly heat the drying fluid above its boiling point. A pressure indicator 132 provides information for controlling the pressure range, and temperature indicator 134 monitors the temperature of the fluid leaving outlet 128. The boiler 124 should always be maintained full of drying fluid so that the heat transfer services are continually immersed. For this purpose, a liquid level detector 135 and switch can be provided. A safety relief valve 136 is provided at the top of boiler 124. A valve 138 controls access to delivery line 122. Also connected to line 122 is a source of gas which is preferably filtered nitrogen. Valve 137 provides access to line 122 for the gas.

To effect drying of the microparts in the vessel, the pressurized organic vapor is introduced into vessel 12 through valves 78 and 76. It is desired to dry the microparts without the formation of bubbles and without leaving droplets or residual moisture on any of the surfaces of the parts, including interior surfaces. Droplets and residual moisture may contain contaminant residues of the solutes. Removal of all residual rinsing solvent is accomplished by providing a flow of hot organic vapor into the vessel in such a manner that the vapor is introduced into the top of the vessel as the rinsing fluid is draining from the bottom, through port 24 and outlet 22. The organic vapor is selected so that it is miscible with the rinsing liquid. In a preferred embodiment, heated isopropyl alcohol (IPA) or acetone vapor is introduced into vessel 12, as the rinsing fluid is displaced downward. Droplets which remain on the surfaces of the microparts are carried off by the organic vapor. The IPA or acetone layer vapor combines with the rinse liquid, which is usually water or a terpene solvent, to form an azeotrope layer which evaporates at a lower temperature than either the rinse liquid or the organic drying solvent. The temperature of the medium being displaced is important. Preferably, the temperature is about 55 to 60° C. If the temperature is much higher the azeotrope layer may break down. Although the organic solvent and the water are miscible, the azeotrope layer remains distinct because of the surface tension and thermal differences between the solvent and the water. Once the rinse liquid has drained completely, vessel 12 is purged of the drying vapor with a flow of clean gas, preferably nitrogen. Nitrogen is introduced into vessel 12 through valves 80 and 76. The azeotropic residue is carried off in the flow of the gas. The resulting microparts are ultraclean after this treatment, and all of the involuted surfaces are dry.

The system can contain spring-loaded units so that, if the failure of the control system for the various valves and units should occur, treatment fluids will flush harmlessly out of the units to the drain, and no excessive pressure buildup will occur. Suitable mechanisms are those described, for example, in U.S. Pat. No. 4,899,767, the teachings of which are hereby incorporated herein by reference.

The method is generally carried out according to the following procedure. The object to be cleaned is placed in vessel 12 having a chamber therewithin, serviced by at least one port 24. The chamber of the vessel is preferably sealed. Fluids used for rinsing and/or cleaning the object are passed into the vessel through port 24 until the surfaces of the object are immersed in the fluid. Ultrasonic or megasonic energy can then be applied to at least one of the fluids in the vessel. The rinsing liquid is drained out slowly to help maintain the integrity of the azeotrope layer. The rate of descent is preferably a rate which avoids turbulence which disrupts the surface tension of the azeotrope layer and avoids leaving droplets, generally about 2 inches per minute or less. The displacement step is preferably carried out at a positive pressure of about 1 to 2 psig.

If an aqueous cleaning protocol is used, the treatment fluids are generally hot and/or cool water for rinsing, and a water/surfactant mixture for cleansing. Aqueous cleaning is the preferred method for removing salts and ionic contaminants. In the semi-aqueous cleaning protocol, hydrocarbon solvents containing one or more surfactants are used as cleaning solvents. Solvents which are useful include, for example, water-miscible alcohols and terpenes. Semi-aqueous cleaning can be used to remove both ionic and organic contaminants. Both protocols allow the contaminants to be rinsed using water. Surfactants which are useful in the cleansing step of the aqueous and semi-aqueous protocols include most types of anionic, nonionic or cationic surfactants.

If a non-aqueous protocol is used, organic solvents are used in the rinsing and cleaning steps. A variety of hydrocarbon solvents can be used for this purpose, including acetone, alcohols and trichloroethane, for example. Organic solvents which are particularly useful for cleaning sensitive electronic microparts, for example, are terpene solvents. Terpenes are organic materials which are found in nature in the essential oils of many plants. Terpenes have carbon skeletons made up of isoprene

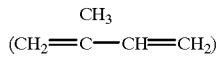

units joined together in a regular, head-to-tail configuration. Terpene compounds include, for example, citronellol, T-terpinene, isoborneol, camphene and squalene. Terpenes can be monocyclic (e.g., dipentene), dicyclic (e.g., pinene), or acyclic (e.g., myrcene). Terpenes which are particularly useful include those available from Petroferm™, Inc., Fernadina Beach, Fla. Terpene solvents are biodegradable and non-toxic, but many have a pungent odor which limits their usefulness in most systems. However, the present system is completely closed, therefore oderous solvents like terpenes can be used. Other useful solvents include, for example, photoresist strippers which are a mixture of an aliphatic amide, such as N-methyl pyrrolidone, and an amine. Useful photoresist strippers include those manufactured by Advanced Chemical Technologies, Bethlehem, Pa. These solvents are hazardous to humans, so exposure must be limited. The present totally enclosed system allows these solvents to be used safely.

The terpene solvents are preferably introduced into the bottom of the vessel, through valve 40 or 42 and port 24 (FIG. 3), and are also drained out through the bottom of the vessel through port 24 into storage tank 58 or 60 for recycling or reuse. Terpenes can be filtered or distilled to remove contaminants and then reused, for example.

Once the object has been cleaned using the non-aqueous method, it can be rinsed and dried in the same vessel, without leaving a residue, by filling the vessel and immersing the object in an organic solvent which is miscible with the cleaning solvent. The organic solvent removes all of the residual cleaning solvent from the object, even from the involuted, hard-to-reach surfaces. The organic solvent rinse is preferably followed by drying using hot organic vapor as described above, which is added to the vessel under super-atmospheric pressure, that is, under pressure of greater than one atmosphere. Organic solvents which are useful for rinsing and drying purposes include compounds having the general formula R—O—R' wherein R and R' comprise organic substitutes having between about two to ten carbon atoms. Isopropyl alcohol and acetone are particularly preferred. In the non-aqueous protocol, both organic solvent rinsing followed by organic vapor drying can be used. The drying step can be followed by purging the vessel with a relatively inert gas, such as nitrogen, and/or with air.

Whether solvent or water is used for the cleaning or rinsing steps will be determined primarily by the type of object to be cleaned and the type of contamination to be removed. For example, salts and ionic contaminants are best removed by an aqueous method. A mixture of ionic and organic contaminants can be removed using a semi-aqueous method, and organic contaminants can be effectively removed using the non-aqueous method. In addition, some plastic components may be attacked by certain solvents and are best cleaned using aqueous liquids. For certain metallic objects, however, the use of water may cause flash corrosion, and are best cleaned using organic liquids.

Ultrasonic or megasonic energy can be supplied, for example, by an ultrasonic or megasonic transducers 16. The sonic transducers 16 can be positioned by or attached to the exterior walls of the vessel, thereby allowing the sonic energy to be directed at the interior of the vessel. The sonic energy causes agitation of the fluid inside the vessel. Ultrasonic energy having a frequency in the range of from about 20 kilohertz (khz) to 40 khz is used. Megasonic energy having a frequency in the range of from about 0.8 megahertz (mhz) to about 1.5 mhz is used for this purpose. Sonic transducers which are useful in the present invention, for example, those available from Ney Corporation, Bloomfield, Conn. under the tradename Prosonic™.

A preferred embodiment of the method of the invention using an aqueous protocol combines the following steps: washing the object by surfactant wet processing and sonic cavitation followed by alcohol vapor drying. Generally, the surfactant wet processing step and sonic cavitation step are performed simultaneously. The first step consists of positioning the object or objects to be cleaned in vessel 12, which is completely enclosed except for the inlets 22, and 34 for admitting and draining the fluids. The apparatus is preferably designed to induce plug-flow to the fluid flowing into the vessel. The term "plug-flow" refers to a liquid flow having a front, transverse to the direction of flow, defined by a generally disc-shaped volume of liquid which contains a concentration gradient produced by the mixing of two liquids at their interface. A configuration for imparting plug-flow is described in detail, for example, in U.S. Pat. No. 4,633,893 the teachings of which are hereby incorporated herein by reference. The vessel is then closed, and the object is rinsed, with hot water. A surfactant is injected into the water to form a surfactant/water mixture, and ultrasonic energy is applied to vessel 12 by transducers 16, thereby causing cavitation of the surfactant/water mixture. For this purpose, ultrasonic transducers can be mounted directly to the processing vessel, for example. When the ultrasonic energy is applied to the solution in the vessel, cavitation occurs in the solution which is instrumental in cleaning the immersed component. Ultrasonic energy is applied for a period of time sufficient to ensure that the immersed product is thoroughly cleansed, e.g., 2 to 10 minutes. The time period will depend upon several factors, such as the configuration of the object, the nature of the contaminants to be removed and the degree of contamination. The object is then rinsed again, preferably with a cool water rinse, followed by a hot water rinse. The fluids used to treat the object are allowed to hydraulically fill the vessel from the bottom thereby surrounding the object while minimizing turbulence and thus avoiding the formation of eddies in the fluids. The term "hydraulically full" as used herein means full of liquid, without gas pockets or phase boundaries. Suitable mechanisms for accomplishing hydraulic filling are described, for example, in U.S. Pat. No. 4,795,497, which is hereby incorporated by reference.

The drying step is then performed. In the first step of this process, an ispropyl (IPA) alcohol vapor is directed into the top of the vessel, through line 122 and valves 78 and 76. The vapor is allowed to fill the vessel as the hot water from the last rinse is removed, thereby displacing it from the top of the vessel. This alcohol vapor drying step is carried out such that substantially all traces of water are removed from the surface of the component including the involuted surfaces which are not outwardly exposed. In this step, the hot rinse water is drained out as the vessel is filled with the IPA vapor. Therefore, as the water level descends, the object emerges from the water into the warm, dry IPA vapor. The rate of descent of the IPA layer is preferably 2 inches per minute or slower. Without wishing to be bound by theory, it is believed that surface tension at the water/IPA liquid interface acts to drive particles down and out of the vessel. The IPA vapor condenses on the receding cooler liquid forming a floating layer of IPA. IPA is miscible with water, but distinct layers are maintained due to the surface tension and density differences between the IPA and water. As the IPA/water interface progresses downward, strong surface tension forces strip away all traces of rinse liquid and particles. The alcohol vapor can be then purged from the vessel by introducing an inert gas, such as nitrogen, through valves 80 and 76.

If necessary or desired, compressed air can be injected into the vessel through valves 80 and 76 to purge any remaining traces of IPA. This process eliminates the problem of flash oxidation of metal parts, which can occur when surfaces which are still wet come in contact with air.

Another embodiment of the method utilizes a semi-aqueous protocol. In this embodiment, the microparts to be cleaned are placed in vessel 12 and the vessel is sealed. The microparts optionally can be prerinsed with water through sprayheads 26. The vessel is then filled with a solvent via line 82 to immerse the objects completely. The solvent can contain a surfactant, and/or can be a water-miscible solvent. Sonic energy is applied to the vessel. The solvent is drained from the vessel via line 82 and valve 72 if the vessel shown in FIG. 1 is used, or through drains 36 and valves 38 if the vessel shown in FIG. 2 is used. The objects are rinsed with hot water. IPA vapor is then introduced into the vessel as described above directly displacing the hot rinse water. The IPA vapor is purged from the vessel with nitrogen, followed by compressed air.

Another preferred embodiment of the method of the invention using a non-aqueous protocol combines the following steps: washing the object with a terpene or mixture of terpenes, and sonic cavitation followed by removal of the terpene solvent with a miscible organic rinsing liquid, preferably IPA or acetone. The first step consists of positioning the object in vessel 12 as described above for the aqueous processing method. Optionally, the object can be precleaned by spraying water or an organic gas or liquid on the parts to remove large dirt particles and oils. The terpene or mixture or terpenes is introduced into vessel 12 through valve 40 and port 24 (FIG. 3), until the object is immersed in the solvent. The terpene solvent may contain a surfactant. Megasonic or ultrasonic energy is applied to the liquid in the vessel. Once the cleaning step is complete, the terpene solvent is drained back into its reservoir 58 through port 24 and valve 40. An optional rinsing step can be performed. The vessel is filled with the liquid rinsing solvent, which is admitted through valve 42. The solvent is selected so that it is miscible with and solubilizes the terpene, thereby removing residual terpene from the surfaces of the object. Water can be used to rinse some water-miscible terpenes. However, solvents, including IPA and acetone, are preferred for this purpose. The solvent is then removed from the vessel by draining it from the vessel through port 24 and through valve 42 into its reservoir 60 for recycling and/or reuse, or through valve 48 for disposal. Hot organic vapor, preferably IPA, is introduced into the top of vessel 12 through valves 78 and 76 such that the vapor displaces the terpene or rinsing solvent. Vessel 12 is then purged with nitrogen gas, to remove all traces of the drying solvent or vapor. Vessel 12, optionally, is purged with compressed air. Following this protocol, the object is ultraclean, that is, substantially all traces of contaminants including those of submicron size have been removed.

Solvents used in the present method can be reused again and again. Terpenes which are used to clean the microparts can be drained back into the holding tank and then reused, since terpenes generally retain their cleaning power through several runs. The terpenes can be filtered by placing a filtering device in the system or can be recycled by outside of the system by distilling, for example, and then reused. IPA or other rinsing or drying solvents also can be reused filtered or recycled. Means for filtering, distilling or recycling organic solvents are well known in the art.

The combination of washing and/or rinsing of the object while applying sonic energy allows the object to be thoroughly cleaned, even if it has involuted surfaces which are not directly exposed to the cleaning liquid and which are hard to reach. For example, hard disks used in the computer industry must be free of contaminants down to the submicron level, because the head of a hard disk assembly "floats" above the disk at a distance of about 0.5 microns or less. The presence of submicron particles on the disk can cause the assembly to "crash". The present method removes substantially all submicron contaminants.

In order to test the cleaning and drying effectiveness of the system, a variety of microparts were tested. Parts which were tested included hard disk heads, complex shaped precision parts, miniature ball bearings and screws. The parts were weighed on a precision balance before and after treatment to determine if any water or other liquid was left behind after treatment. The presence of the liquid would increase the net weight of the parts. The results showed that using the present apparatus and methods, all liquids were removed even from the most complex mechanical structures.

Components were fixtured and placed into a 10-liter stainless steel vessel chamber where the entire cleaning and drying operation was completed. Fluids sequentially filled the chamber entering via a stationary helical spinner located at the bottom of the chamber. Ultrasonic transducers, mounted to the sidewalls of the vessel chamber, caused cavitation of the liquid surrounding the components thereby enhancing the removal of contaminants. These transducers operate to a maximum of 600 watts of power, and are manufactured by J. M. Ney Company of Bloomfield, Conn.

Process fluids flowed in from the bottom through inlet 22 filling the vessel 12 chamber and flowed out the top, through outlet 32 as shown in FIG. 1. The chamber was just large enough to hold the parts to be cleaned, and was designed such that the fluid dynamics of the water and chemicals entering the bottom filled the chamber as a uniform plug and traverse past the parts to be cleaned in a repeatable manner, as described above.

In several of the cleaning cases, a closed loop system, as shown in FIG. 1, continuously circulated cleaning chemicals for uniformity and agitation. Chemical injection was accomplished by applying nitrogen gas to pressurized canisters of chemicals as shown in FIG. 2. Hot water rinsed the chamber at flow rates of about 1 to 5 gpm. Alternately, in the non-aqueous cleaning processes, no water was used for rinsing. Instead, a drying solvent was used.

Following cleaning and rinsing, warm IPA vapor entered the top of the chamber where it condensed on the surface of the cooler, receding liquid, forming a measurable layer of liquid IPA as described in detail above. At the same time, a pump slowly drained the remaining fluid out the bottom of the chamber, through line 82 or 84. Prior to opening the chamber, nitrogen gas purged any remaining IPA vapor, eliminating the possibility of flash oxidation.

Various parts from a variety of diverse market segments were cleaned using the present protocols. All parts were actual production components which were cleaned and tested either in the manufacturer's location or in a laboratory. The parts were tested to show the effectiveness of the cleaning equipment by measuring contaminant removal.

The primary contaminants to be removed from the majority of precision components are ionics, organics and particulates. Ionics, such as sodium chloride (NaCl) was removed by deionized water, and residual ionic material was measured with an ionograph to determine the total number of equivalents of NaCl inmicrograms ($\mu$g). Organics are non-water soluble films that were removed by solvents, or in some cases, IPA. These were measured by gas chromotography/mass spectrometry (GC/MS) analysis. Particulate removal was measured by rinsing the part with water and measuring the solute with a liquid particle counter (LPC). Dryness was measured by weighing the sample with an analytical balance prior to and after the cleaning. The part was allowed to cool for several minutes prior to the measurement.

The following examples which illustrate the present invention are not intended to be limiting in any way.

EXAMPLE 1

Disk Drives

The disk-drive market has shown increasing pressure to condense more information into smaller line widths. This has created a need for cleaning all parts having the potential to release submicron-size particles. Many of the components are small and intricate with complex involuted surfaces manufactured from a variety of materials. To add to the problem, cleaning must be accomplished after assembly of many subcomponents. The following is a list a few of the major components comprising a disk-drive assembly:

| | |
|---|---|
| Disk | Aluminum or ceramic substrate w/cobal/nickel & phosphorous layer |
| Covers | Aluminum casting with epoxy paint |
| Flex Cables | Captain (polyamid) with acrylic adhesive |
| Actuator comb | Aluminum, magnesium, or plastic |
| E-Block | Aluminum actuator assembly with ceramic heads |
| Various hardware | 316 SS threaded components |

An aqueous protocol was used to clean these parts. The surfactant used was a 1% water solution of Caviclean #2 made by Turco Products, Inc. of Westminster, Calif. This was chosen because it contains no chlorides which have deleterious effects on the ceramic heads.

Three parts, are actuator assembly, E-block assembly and bumper assembly, were selected to be cleaned because of their complexity. The parts were weighed with an analytical balance before and after the cleaning operation.

In the evaluation of other cleaning systems, there was difficulty with drying the parts without leaving water droplets behind.

The following recipe was used:

| Recipe for Cleaning Disk-Drives | |
|---|---|
| Fill Vessel with water and 1% surfactant @ 45° C. | 1 minute |
| Soak and apply Ultrasonic energy | 4 minutes |
| Rinse wafers with DI water @ 50° C. | 5 minutes |
| IPA Dry | 5 minutes |
| N2 Purge | 1 minute |
| Air Dry | 1 minute |
| TOTAL | 17 minutes |

The results are shown in the following Tables:

TABLE A

| Actuator Assembly (Pre and Post Cleaning) | | |
|---|---|---|
| Initial Weight (gms) | Final Weight (gms) | Net Change Δ |
| 5.201 | 5.201 | 0.000 |
| 5.250 | 5.250 | 0.000 |
| 5.302 | 5.300 | −0.002 |
| 5.287 | 5.284 | −0.003 |
| 5.224 | 5.222 | −0.002 |
| 5.203 | 5.201 | −0.002 |
| 5.309 | 5.309 | 0.000 |
| 5.264 | 5.263 | −0.001 |
| 5.279 | 5.278 | −0.001 |
| 5.279 | 5.280 | +0.001 |

TABLE B

| E-Block Assembly (part of Disc Drive) | | |
|---|---|---|
| Initial Weight (gms) | Final Weight (gms) | Net Change Δ |
| 23.241 | 23.246 | +0.005 |
| 23.163 | 23.168 | +0.005 |
| 23.087 | 23.092 | +0.005 |

TABLE C

| Bumper Assembly (Pre and Post Cleaning) | | |
|---|---|---|
| Initial Weight (gms) | Final Weight (gms) | Net Change Δ |
| 0.403 | 0.405 | 0.002 |
| 0.398 | 0.400 | 0.002 |
| 0.390 | 0.391 | 0.001 |
| 0.398 | 0.399 | 0.001 |
| 0.394 | 0.398 | 0.004 |
| 0.396 | 0.396 | 0.000 |
| 0.393 | 0.394 | 0.001 |
| 0.391 | 0.392 | 0.001 |
| 0.400 | 0.401 | 0.001 |
| 0.394 | 0.398 | 0.004 |
| 0.396 | 0.397 | 0.001 |
| 0.398 | 0.399 | 0.001 |
| 0.395 | 0.396 | 0.001 |
| 0.385 | 0.385 | 0.000 |
| 0.380 | 0.383 | 0.003 |

EXAMPLE 2

As another example, an assembly consisting of an electromechanical coil of wire and a spring loaded locking device was cleaned using the method. The product was also cleaned for comparison by conventional methods using Freon™ vapor degreasers. The following recipe was used:

| Recipe Used in Cleaning Electromechanical Coils | |
|---|---|
| Fill Vessel with DI water @ 60° C. | 2 minutes |
| Inject Surfactants to 1/2% concentration | 2 minutes |
| Circulate chemical in Chamber | 1 minute |
| Ultrasonic energy | 2 minutes |
| Rinse with Hot DI water @ 60° C. to 10 Meg | 10 minutes |
| IPA Dry | 15 minutes |
| N2 Purge | 3 minutes |
| TOTAL | 40 minutes |

The following results were obtained:

The number of particles rinsed from the part were measured with a Liquid Particle Counter on five samples:

| Freon ™ Vapor Degreaser | Aqueous clean with IPA dry |
|---|---|
| 23.1 μg | 3.4 μg |

The average cleanliness level for five parts cleaned by each method was measured with an Ionograph 500M:

| Freon ™ Vapor Degreaser | Aqueous clean with IPA dry |
|---|---|
| 35,050 particles > 5 micron | 13,217 particles > 5 micron |

EXAMPLE 3

Stainless Steel Screws

In another example, 200 stainless steel screws were placed in a basket to determine the cleaning and drying potential on screws "buried" with close contact in all dimensions. The parts were cleaned using the following recipe:

| Recipe Used in Cleaning Stainless Steel Screws | |
|---|---|
| Fill Vessel with water & 0.5% surfactant @ 60° C. | 2 minutes |
| Ultrasonic Energy | 2 minutes |
| Rinse wafers with DI water @ 60° C. | 5 minutes |
| IPA Dry | 5 minutes |
| N2 Purge | 1 minute |
| Air Dry | 1 minute |
| TOTAL | 16 minutes |

Again, the parts were weighed with an analytical balance before and after the cleaning operation. The results are shown in Table D:

TABLE D

| Stainless Steel Screws (Pre and Post Cleaning) | | | |
|---|---|---|---|
| | Initial Weight (gms) | Final Weight (gms) | Net Change Δ |
| 2–56 | 86.391 | 86.378 | −0.013 |
| | 87.376 | 87.355 | −0.021 |
| | 83.771 | 83.767 | −0.004 |
| 6–32 | 174.507 | 174.482 | −0.025 |
| | 173.764 | 137.719 | −0.045 |
| | 172.916 | 172.900 | −0.016 |

The post-cleaning weights were reduced significantly, demonstrating that a measurable number of contaminants were removed from the screws.

EXAMPLE 4

Gyroscopes

Mechanical gyroscopes are manufactured from a variety of metals, plastics, epoxies, and insulated wires. The parts that must be cleaned are small and intricate, and are currently cleaned with Freon™ and 1-1-1 Trichloroethane in ultrasonic degreasers. The real challenge is in the cleaning and drying of the subassemblies, which are susceptible to cleaning solution remaining in blind holes. These assemblies were cleaned and dried in liquid IPA followed by vapor phase IPA. The assemblies were weighed with an analytical balance before and after the cleaning operation. The gyroscopes were cleaned using the following recipe:

| Recipe Used in Cleaning Gyroscopes | |
|---|---|
| Fill Vessel with liquid IPA @ 60° C. | 2 minutes |
| Ultrasonic at 100% power | 2 minutes |
| IPA Dry | 4 minutes |
| N2 Purge | 1 minute |
| Air Dry | 1 minute |
| TOTAL | 10 minutes |

The results are shown in Table E:

TABLE E

| Gyroscope Assemblies (Pre and Post Cleaning) | | |
|---|---|---|
| Initial Weight (gms) | Final Weight (gms) | Net Change Δ |
| 17.292 | 17.285 | −0.007 |
| 15.832 | 15.831 | 0.001 |

EXAMPLE 5

Ball Bearings

Ball bearing assemblies of stainless steel construction are traditionally cleaned using Freon™ and 1-1-1 trichloroethane in vapor degreasers. Ball bearing assemblies were cleaned using the present protocol with an aqueous solution with DI water and a surfactant, 0.2% Immunol S-6 from the Harry Miller Corporation of Philadelphia, Pa. The assemblies consisted of a ring shaped annular carrier containing a series of ball bearings within the annular cavity.

The bearings were cleaned using the following recipe:

| Recipe Used in Cleaning Ball Bearings: | |
|---|---|
| Fill Vessel with water & 0.2% Immunol S-6 @ 65° C. | 1 minute |
| Soak and apply Ultrasonic energy | 10 minutes |
| Rinse wafers with DI water @ 65° C. | 6 minutes |
| IPA Dry | 1 minute |
| N2 Purge | 2 minutes |
| Air Dry | 4 minutes |
| TOTAL | 24 minutes |

The degree of cleaning was determined by visual inspection of the internal surfaces of the bearing ring after cannibalizing a cleaned assembly. No particulate contamination should be seen under a 20× power binocular microscope. Secondly, cleaned bearing races were placed under load conditions and tested for torque measurements caused by contamination.

TABLE F

| Ball Bearings Bearing Race Assemblies of Decreasing Size (Pre and Post Cleaning) | | |
|---|---|---|
| Initial Weight (gms) | Final Weight (gms) | Net Change Δ |
| 32.003 | 31.975 | −0.028 |
| 31.962 | 31.946 | −0.016 |
| 15.173 | 15.167 | −0.006 |
| 15.228 | 15.213 | −0.015 |

TABLE F-continued

| Ball Bearings Bearing Race Assemblies of Decreasing Size (Pre and Post Cleaning) | | |
|---|---|---|
| Initial Weight (gms) | Final Weight (gms) | Net Change Δ |
| 5.715 | 5.707 | −0.008 |
| 5.530 | 5.532 | −0.002 |
| 0.526 | 0.525 | −0.001 |
| 0.485 | 0.482 | −0.003 |

The results, shown in Table F, indicate that 100% yield was obtained.

EXAMPLE 6

Drill Bits

Precision drill bits used for drilling printed circuit boards were cleaned using the present protocal. Cutting oils and metal shavings must be removed from surfaces left from the machining operation. Precision drill bits are typically cleaned with Freon™ vapor degreasers. In the present example aqueous based cleaning was done with a surfactant followed by IPA vapor drying, using the following recipe:

| Recipe Used in Cleaning Precision Drill Bits | |
|---|---|
| Fill Vessel with water & 1% surfactant @ 60° C. | 2 minutes |
| Ultrasonic Energy | 2 minutes |
| Rinse wafers with DI water @ 60° C. | 5 minutes |
| IPA Dry | 5 minutes |
| N2 Purge | 1 minute |
| Air Dry | 1 minute |
| TOTAL | 16 minutes |

In order to eliminate the water rinsing and reduce the recipe time, a non-aqueous recipe using IPA as the rinsing and drying agent and a terpene solvent, BIOACT 121 (Petroferm, Inc.) which is a mixture of orange terpenes were used in the cleaning process. The stainless steel rack of carbide drill bits was dipped into a bath of the BIOACT 121 for five seconds and then immediately placed into the rack into the vessel for cleaning. Liquid IPA was pumped into the vessel and then ultrasonics were applied to the solution. An IPA vapor dry was performed as the liquid IPA drained back into the reservoir. The following recipe was used:

| Non-Aqueous Recipe For Drill Bits | |
|---|---|
| Dip in BIOACT 121 | 5 seconds |
| Fill Vessel with liquid IPA @ 60° C. | 2 minutes |
| Ultrasonic | 2 minutes |
| IPA Dry | 4 minutes |
| N2 Purge | 1 minute |
| Air Dry | 1 minute |
| TOTAL | 10 minutes |

Cleanliness was determined by using a binocular microscope to search for particulate left on the drill bit flutes and the shank. An important consideration is the complete removal of all residual oil, especially at the points of contact with the drill bit and the stainless holder. In both recipes, aqueous and non-aqueous, the desired level of cleanliness was achieved.

EXAMPLE 7

Photoresist Stripping

The solvents traditionally used for photoresist stripping of silicon wafers are highly flammable and very aggressive, and therefore handled with care. Photoresist strippers are typically made up of two components, the base solvent is an aliphatic amide, such as N-Methyl pyrrolidone, and an amine. The problem is that plasma etching processes use to etch the parts leave chlorine atoms in the vertical profile of the etched metal. When exposed to DI water, acids are formed which etch the aluminum-copper metal ions. This is especially problematic in submicron line geometry where critical dimension loss (CD loss) can etch greater than 0.2 microns, which means that the space between metal lines has increased.

In this example a photoresist compound was used: ACT™ CMI-A (manufactured by Advanced Chemical Technologies, Inc. of Bethlehem, Pa.), which is a positive resist stripper and is specially formulated for the removal of resists on highly corrosion-sensitive metals and metal alloys. 125 mm wafers were coated with photoresist, then cleaned and dried using two different cleaning techniques. In one run the wafers were rinsed with water after the stripping, and in the other IPA vapor was used to dry the stripper without any water. In order to insure that any salts were removed prior to stripping, a rinse and dry operation preceded the stripping operation.

| The photoresist stripping recipes were: | |
|---|---|
| Rinse wafers with DI water @ 50° C. | 2 minutes |
| IPA Dry | 5 minutes |
| Fill Vessel with ACT-CMI-A @ 75° C. | 2 minutes |
| Ultrasonic energy | 12 minutes |
| Drain ACT from vessel | 2 minutes |
| Rinse wafers with DI water @ 50° C. | 5 minutes |
| IPA Dry | 10 minutes |
| N2 Purge | 4 minutes |
| TOTAL | 42 minutes |

and

| | |
|---|---|
| Rinse wafers with DI water @ 50° C. | 2 minutes |
| IPA Dry | 5 minutes |
| Fill Vessel with ACT-CMI-A @ 75° C. | 2 minutes |
| Ultrasonic energy | 12 minutes |
| IPA Dry | 10 minutes |
| N2 Purge | 4 minutes |
| TOTAL | 35 minutes |

After cleaning, the wafers were tested using microfluoressence to determine whether the resist has been completely removed. The CD loss was measured for the water rinse recipe and the IPA dry recipe with no water rinsing. It was determined that the recipe with no post etch rinsing had a lower CD loss. In this case the photoresist stripper solvent was directly displaced with IPA vapor without the need for a water rinse.

EXAMPLE 8

Ceramics

Ceramics are used for everything from hard disk-drives to transducers. They are generally cleaned using Freon™ cleaning operations. In this example, ceramic sonar tranducers were cleaned without the use of an aqueous cleaner because the ceramics absorb water which distorts the resonance of the transducer. After cleaning and drying, the entire unit is encapsulated in an epoxy to prevent water from entering the pores of the ceramic. The following complete solvent clean and dry recipe was used:

| Recipe Used in Cleaning Ceramics | |
|---|---|
| Fill Vessel with liquid IPA @ 60° C. | 2 minutes |
| Ultrasonic at 100% power | 2 minutes |
| IPA Dry | 4 minutes |
| N2 Purge | 1 minute |
| Air Dry | 1 minute |
| TOTAL | 10 minutes |

Heated liquid IPA filled the vessel and immersed the transducers, then ultrasonics was used to help remove external contaminants. An IPA vapor dry insured that components were completely dry. This process completely eliminated the need for Freon™'s by replacing them with IPA liquid and vapor. Simultaneously, it insured that no water was absorbed into the hydroscopic ceramic surface.

Equivalents

One skilled in the art will be able to ascertain many equivalents to the specific embodiments described herein. Such equivalents are intended to be encompassed by the scope of the following claims.

What is claimed is:

1. A method for treating an object having one or more surfaces, comprising:

placing the object in a vessel;

introducing an organic solvent into the vessel;

contacting the surfaces of the object with the organic solvent; and removing the organic solvent from the surfaces of the object by directly displacing the organic solvent from the surfaces of the object with a fluid comprising a drying vapor by controlling conditions within the vessel such that substantially no liquid droplets of the organic solvent or the drying vapor are left on the surfaces of the object to evaporate after the direct displacement of the organic solvent with the fluid.

2. The method of claim 1 wherein the step of introducing the organic solvent comprises introducing the organic solvent which comprises an organic photoresist stripping solvent.

3. The method of claim 1 wherein the step of introducing the organic solvent comprises introducing the organic solvent which comprises N-methyl pyrrolidone.

4. The method of claim 1 wherein the step of introducing the organic solvent comprises introducing the organic solvent which includes isopropyl alcohol.

5. The method of claim 1 wherein the drying vapor comprises isopropyl alcohol or acetone.

6. The method of claim 1 wherein the drying vapor comprises a compound having the formula R—O—R', wherein R comprises an organic radical having between 2 to about 10 carbon atoms and R' comprises an organic radical having between 2 to 10 carbon atoms or hydrogen.

7. The method of claim 1 wherein the removing step comprises removing the organic solvent from the surfaces of the object by pushing the organic solvent downwardly with the fluid comprising the drying vapor.

8. The method of claim 1 wherein the removing step comprises removing the organic solvent from the surfaces of the object by drawing away the organic solvent as the fluid comprising the drying vapor pushes downwardly on the organic solvent.

9. The method of claim 1 wherein the placing step comprises placing the object which comprises a semiconductor wafer.

10. The method of claim 1 wherein the contacting step further comprises applying sonic energy to the surfaces of the object and the organic solvent.

11. The method of claim 10 wherein the contacting step further comprises applying the sonic energy which has a frequency of from about 20 to about 40 kilohertz.

12. The method of claim 10 wherein the contacting step further comprises applying the sonic energy which has a frequency of from about 0.8 to about 1.5 megahertz.

13. The method of claim 1 wherein the placing step comprises placing the object in the vessel which comprises a sealable enclosure.

14. The method of claim 1 wherein the placing step further comprises placing the object in the vessel and holding the object stationary within the vessel during all steps of the method.

15. The method of claim 14 wherein the placing step comprises placing the object in the vessel which comprises a sealable enclosure.

16. The method of claim 1 wherein the placing step comprises placing a plurality of the objects in the vessel.

17. The method of claim 1 wherein the removing step comprises removing the organic solvent from the surfaces of the object by directly displacing the organic solvent from the surfaces of the object with the fluid comprising the drying vapor by controlling the rate at which the fluid directly displaces the organic solvent such that substantially no liquid droplets of the organic solvent or the drying vapor are left on the surfaces of the object to evaporate after the direct displacement of the organic solvent with the fluid.

18. The method of claim 1 wherein the removing step comprises removing the organic solvent from the surfaces of the object by directly displacing the organic solvent from the surfaces of the object with the fluid comprising the drying vapor by controlling pressure in the vessel such that substantially no liquid droplets of the organic solvent or the drying vapor are left on the surfaces of the object to evaporate after the direct displacement of the organic solvent with the fluid.

19. The method of claim 1 wherein the removing step comprises removing the organic solvent from the surfaces of the object by directly displacing the organic solvent from the surfaces of the object with the fluid comprising the drying vapor by controlling the temperature of at least the organic solvent such that substantially no liquid droplets of the organic solvent or the drying vapor are left on the surfaces of the object to evaporate after the direct displacement of the organic solvent with the fluid.

20. The method of claim 1 wherein the removing step comprises removing the organic solvent from the surfaces of the object by directly displacing the organic solvent from the surfaces of the object with the fluid comprising the drying vapor by controlling condensation of the drying vapor on the surfaces of the object such that substantially no liquid droplets of the organic solvent or the drying vapor are left on the surfaces of the object to evaporate after the direct displacement of the organic solvent with the fluid.

21. The method of claim 1 wherein the removing step comprises removing the organic solvent from the surfaces of the object by directly displacing the organic solvent from the surfaces of the object with the fluid comprising the drying vapor by controlling the temperature of at least the fluid such that substantially no liquid droplets of the organic solvent or the drying vapor are left on the surfaces of the object to evaporate after the direct displacement of the organic solvent with the fluid.

22. The method of claim 1 further comprising the step of purging the vessel of the fluid comprising the drying vapor after the removing step with an inert gas, wherein the inert gas comprises nitrogen or argon.

23. The method of claim 1 wherein the step of introducing the organic solvent comprises introducing the organic solvent which comprises an alcohol.

* * * * *